US007040200B2

(12) United States Patent
Lin

(10) Patent No.: US 7,040,200 B2
(45) Date of Patent: May 9, 2006

(54) DRIVING TOOL HAVING IRROTATABLE BARS

(75) Inventor: Chorng-Jiang Lin, Taichung (TW)

(73) Assignee: Triangle Innovation Corporation, Taichung (TW)

( * ) Notice: Subject to any disclaimer, the term of this patent is extended or adjusted under 35 U.S.C. 154(b) by 38 days.

(21) Appl. No.: 10/866,659

(22) Filed: Jun. 15, 2004

(65) Prior Publication Data

US 2005/0274233 A1 Dec. 15, 2005

(51) Int. Cl.
*B25B 23/16* (2006.01)

(52) U.S. Cl. ..... 81/177.5; 81/177.85

(58) Field of Classification Search ..... 81/177.5, 81/177.2, 177.8, 177.85, 124.3–124.7
See application file for complete search history.

(56) References Cited

U.S. PATENT DOCUMENTS

| | | | | |
|---|---|---|---|---|
| 1,724,491 | A * | 8/1929 | Mandl | 81/177.85 |
| 2,593,828 | A * | 4/1952 | Arey | 81/177.2 |
| 2,968,980 | A * | 1/1961 | Zierold | 81/177.5 |
| 3,813,967 | A * | 6/1974 | De Haven | 81/177.2 |
| 4,781,085 | A * | 11/1988 | Fox, III | 81/177.85 |
| 5,272,942 | A * | 12/1993 | Hull et al. | 81/124.4 |
| 6,260,452 | B1 * | 7/2001 | Yu | 81/177.2 |

* cited by examiner

*Primary Examiner*—Hadi Shakeri
(74) *Attorney, Agent, or Firm*—Rosenberg, Klein & Lee

(57) ABSTRACT

A driving tool includes a driving head with a passage defined therethrough so that a bar movably extends through the passage. A driving protrusion extends from a bottom end of the driving head and a top hole is defined through a top of the driving head. A positioning member is received in the driving head. The bar has a positioning portion which is engaged with the positioning member so that the bar is not rotatable in the passage.

8 Claims, 8 Drawing Sheets

DRIVING TOOL HAVING IRROTATABLE BARS

FIELD OF THE INVENTION

The present invention relates to a driving tool having movable tool bars each of which has a plane surface and a positioning member is received in the driving head so as to position the bar at position.

BACKGROUND OF THE INVENTION

A conventional driving tool that is disclosed in FIG. 7 and generally includes a driving head 10 which has a driving protrusion 11 extending from an end thereof so as to be engaged with a sleeve or a socket for example. A passage is defined through the head 10 and a bar 20 movably extends through the passage. The user holds the bar 20 and rotates the head so as to tighten or loosen an object such as a bolt head or a nut. Although the bar 20 can be moved through the passage to adjust the arm of force when applying a torque to the object. The bar 20 has a circular cross section and the passage is a round through hole, so that the bar 20 could be rotated when the user operates it. The user's hand could slip from the bar 20 and hit objects around the tool. Furthermore, after the user releases the bar 20, the bar 20 moves due to the gravity if the bar 20 is oriented an angle relative to the top of the table or the floor. The user has to re-arrange the bar 20 to a desired position again and this costs a lot of time.

FIG. 8 shows another cruciform driving tool which has two bars 20 fixedly connected at two respective intermediate points thereof and each bar 20 has a reception end for accommodate a bolt head or a nut therein. Unfortunately, the two bars 20 are fixed with each other and occupy a lot of space which is not convenient for storage. Although the two bars 20 can be made to be pivotably connected each other, the pivot area will be a weak spot which cannot bear a large torque.

The present invention intends to provide a driving tool that has a positioning member for preventing the bar from rotating in the passage of the driving head.

SUMMARY OF THE INVENTION

The present invention relates to a driving tool that comprises a driving head and a passage is defined through the driving head. A driving protrusion extends from a bottom end of the driving head and a positioning member is received in the driving head. A bar movably extends through the passage and has a positioning portion which is a plane surface and engaged with the positioning member such that the bar is not rotatable in the passage.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
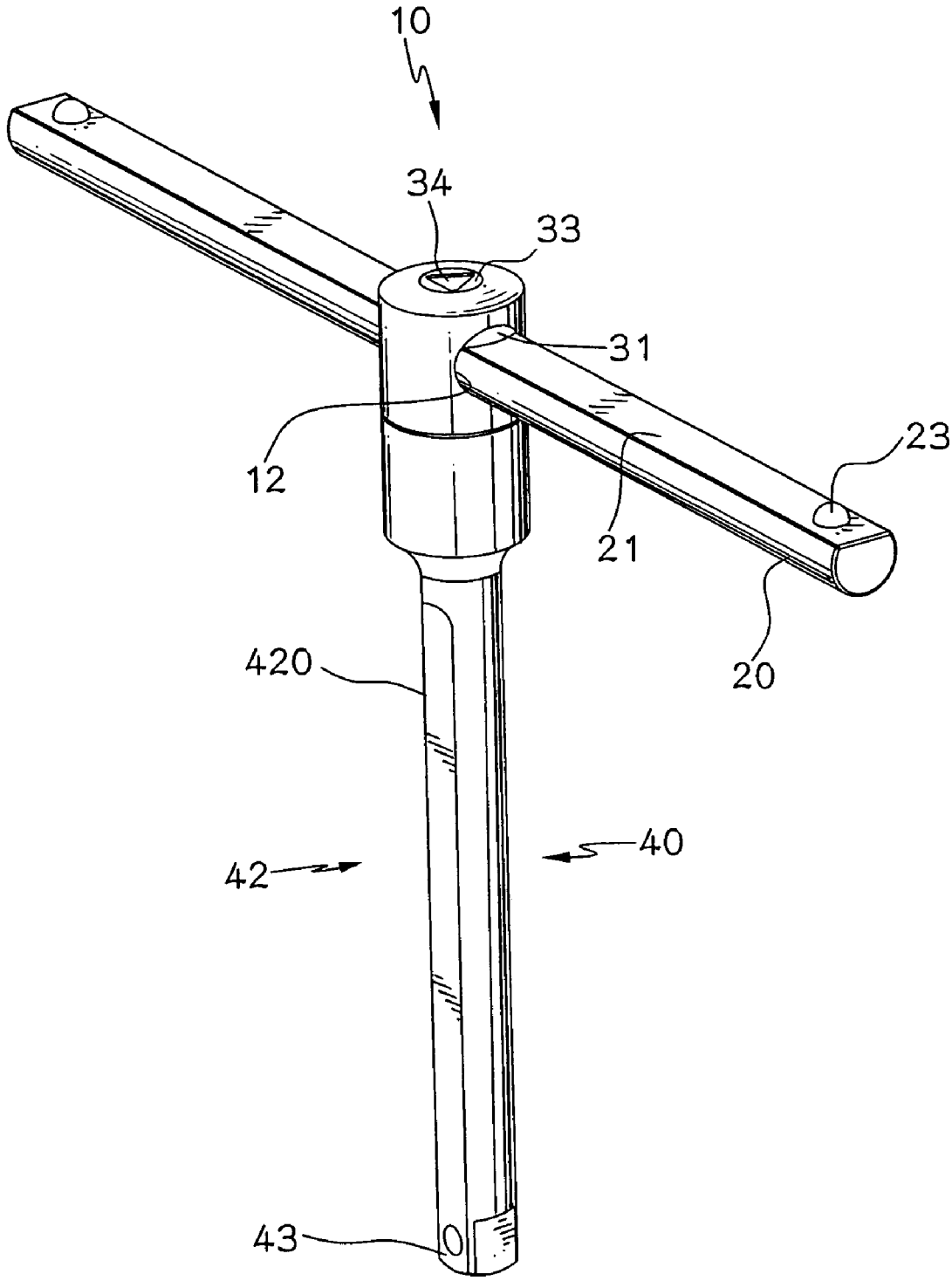
FIG. 1 is a perspective view to show the driving tool of the present invention.
Figure 2:
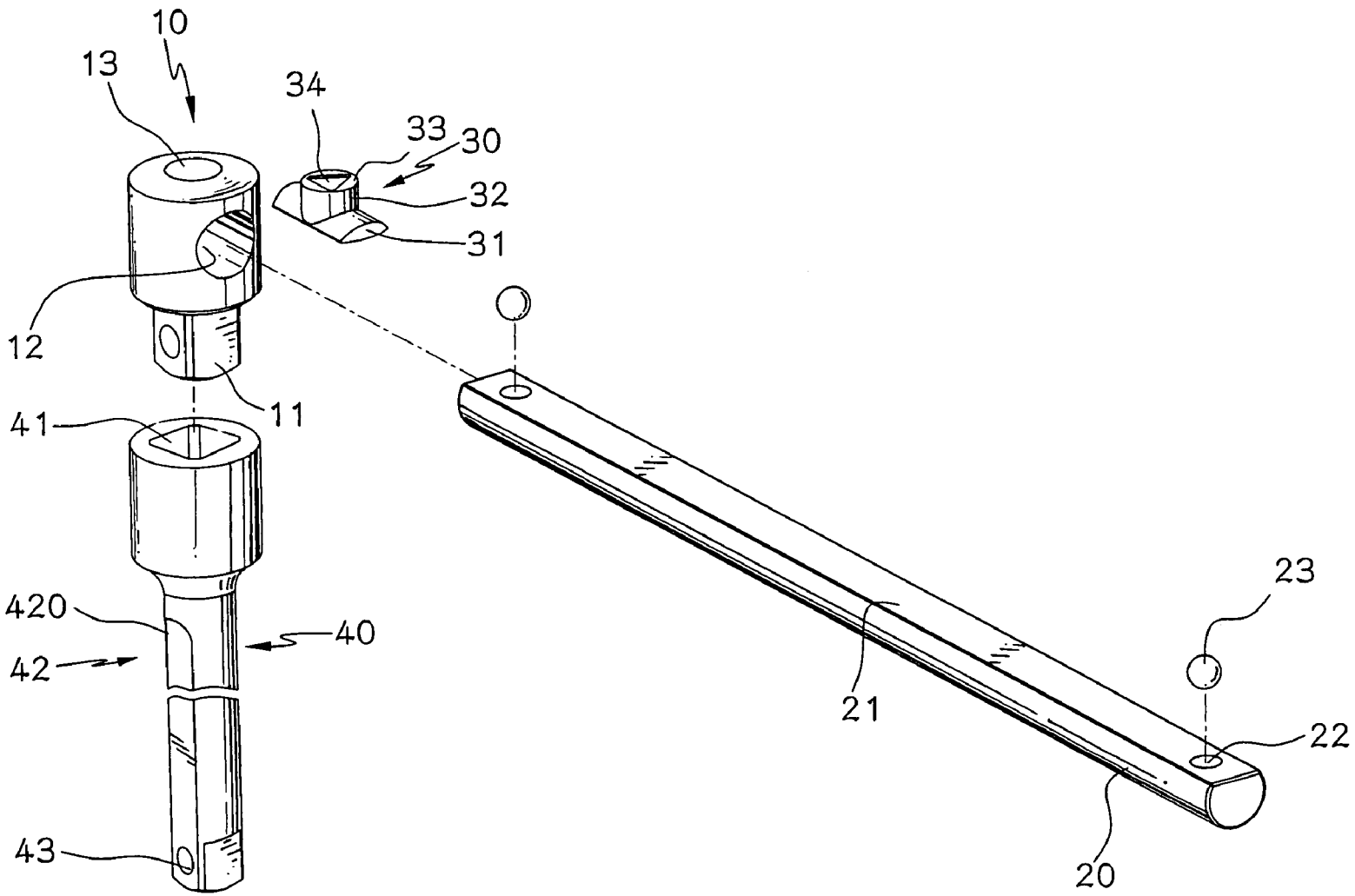
FIG. 2 is an exploded view to show the driving tool of the present invention.

Referring to FIGS. 1 and 2, the driving tool of the present invention comprises a driving head 10 and a passage 12 is transversely defined through the driving head 10. A driving protrusion 11 extends from a bottom end of the driving head 10 so as to be connected to a socket or the like. A top hole 13 is defined through a top of the driving head 10.

A positioning member 30 is received in the driving head 10 and includes two arms 31 and a top portion 32 which extends through the top hole 13 of the driving head 10. A display end surface 33 is defined in a distal end of the top portion 32 and projects out from the top hole 13. A display pattern 34 is connected on the display end surface 33 so as to display a logo or a size mark thereon. Each of the two arms 31 has a plane surface defined in an underside thereof.

A bar 20 movably extends through the passage 12 and has a positioning portion 21 which is a plane surface defined in an outer surface thereof and the positioning portion 21 is engaged with plane surface of the two arms 31 of the positioning member 30 so that the bar 20 is not rotatable in the passage 12. Two boss 23 are engaged with two recesses 22 defined in two ends of the positioning portion 21 so as to prevent the bar 20 from dropping out from the passage 12.

Figure 3:
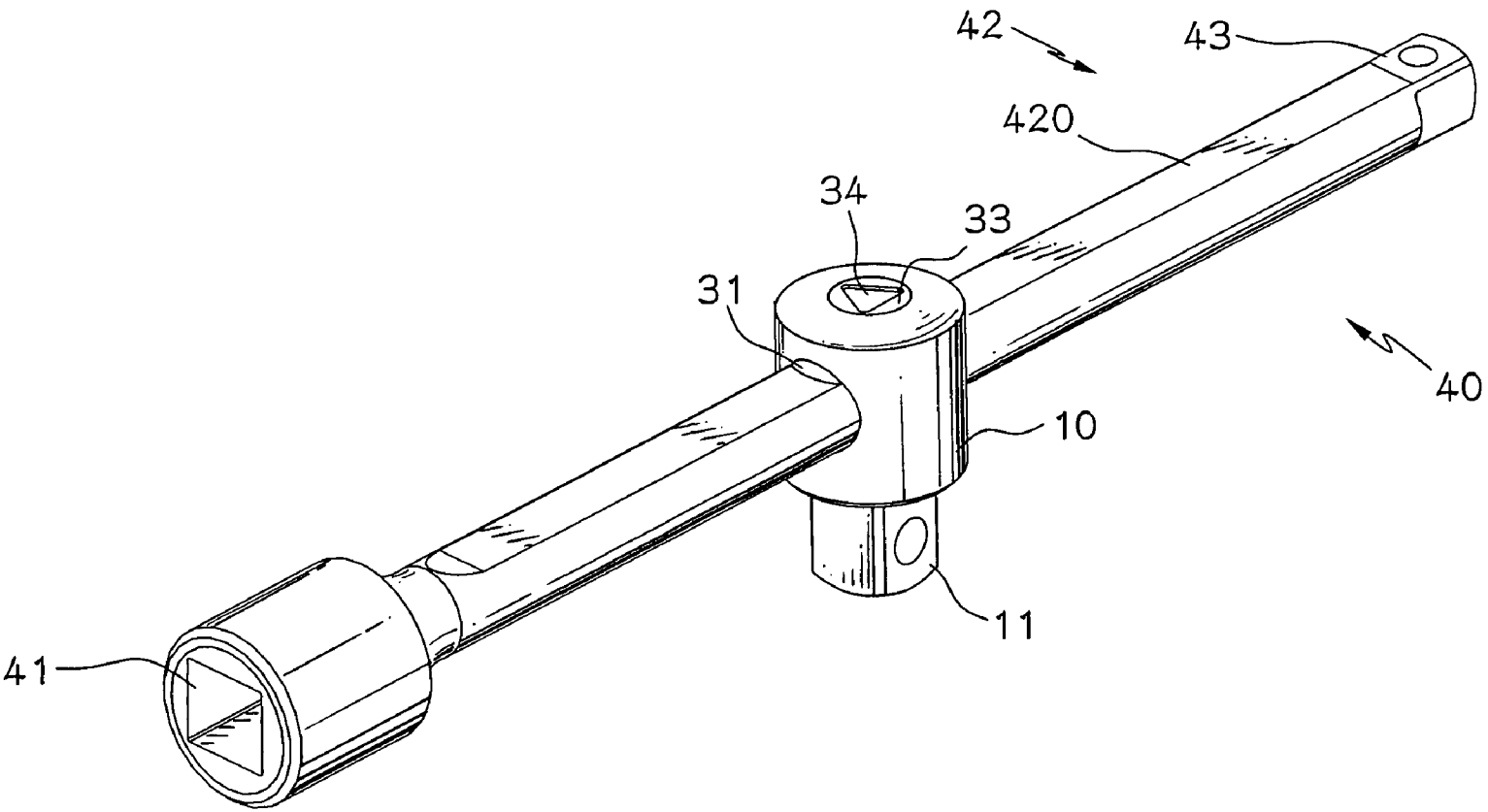
FIG. 3 shows a tool bar extends through the driving head of the driving tool of the present invention.

A connection rod 40 includes an elongate rod 42 which has a driving end 41 with a recess in a first end of the connection rod 40 so as to receive the driving protrusion 11 on the driving head 10, and a connection end 43 is connected to a second end of the connection rod 40. The connection end 43 can be connected to a socket to drive a screw or the like. A plane surface 420 is defined in an outer surface of the connection rod 40. Further referring to FIG. 3, the connection rod 40 can also be extended through the passage 12 of the driving head 10 and the plane surfaces of the arms 31 of the positioning member 30 are in contact with the plane surface 420 of the connection rod 40.

Figure 4:
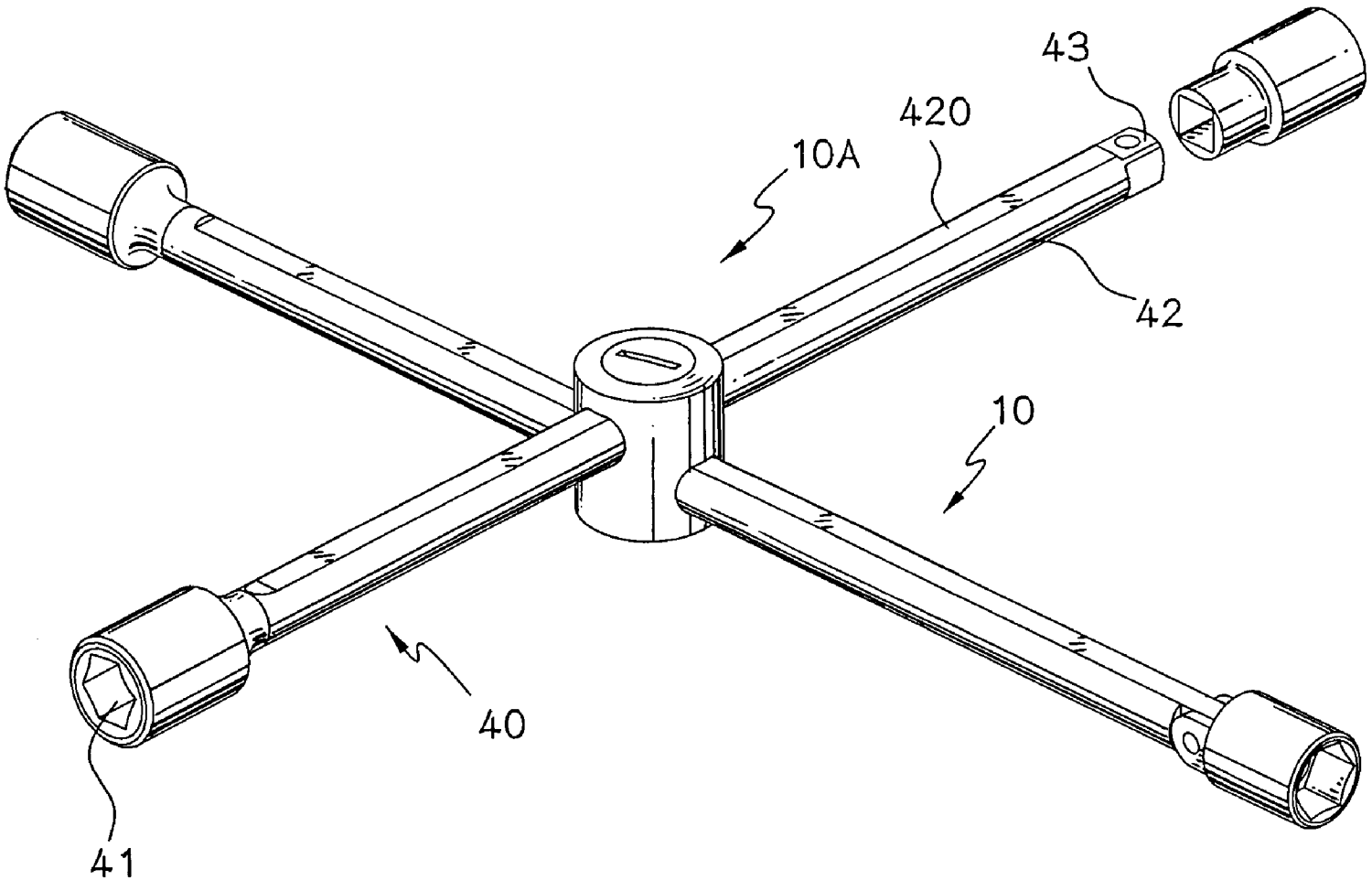
FIG. 4 is a perspective view to show another embodiment of the driving tool of the present invention.
Figure 5:
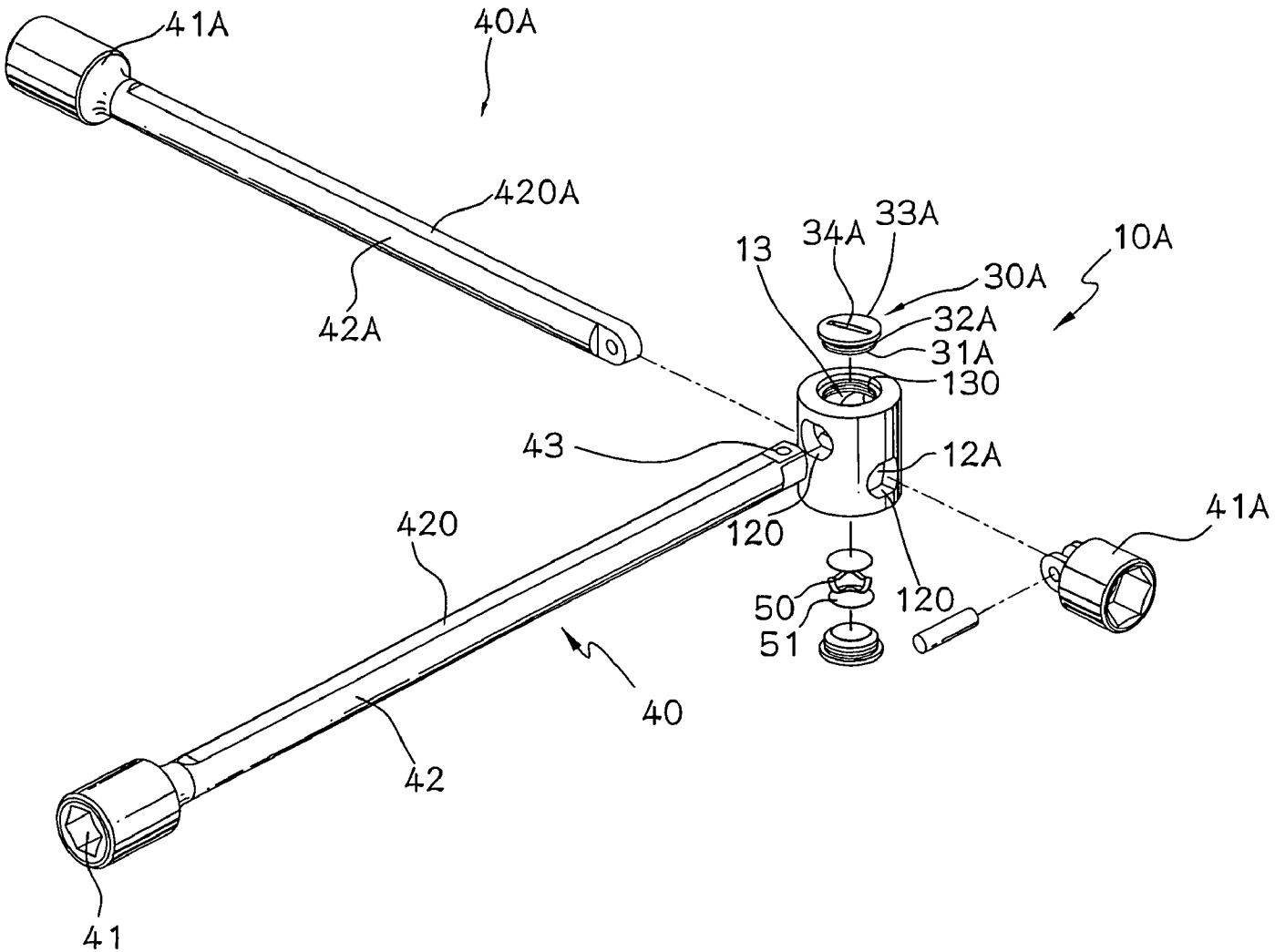
FIG. 5 is an exploded view to show the driving tool in FIG. 4 of the present invention.
Figure 6:
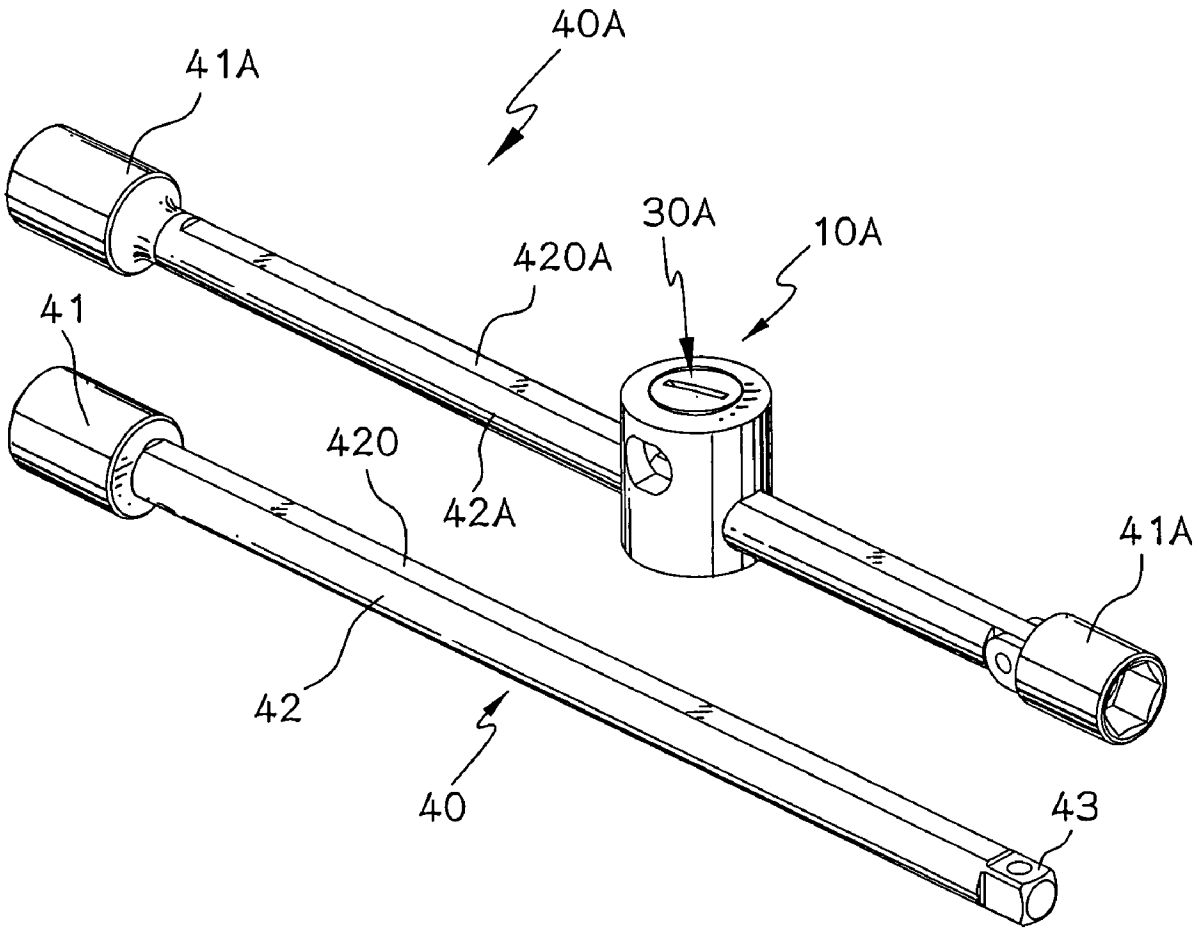
FIG. 6 shows two tool bars and the driving head of the driving head of the driving tool in FIG. 4.
Figure 7:
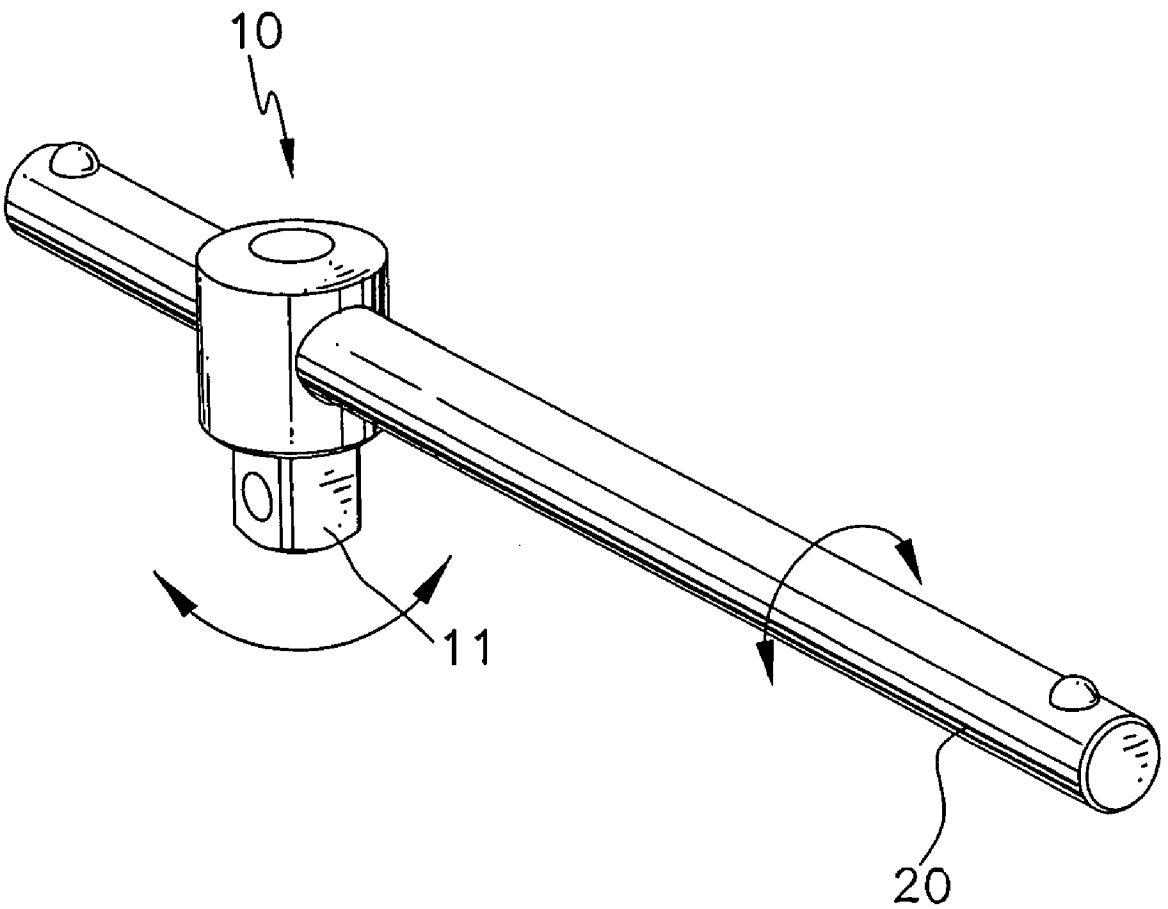
FIG. 7 PRIOR ART
FIG. 7 shows a conventional driving tool.
Figure 8:
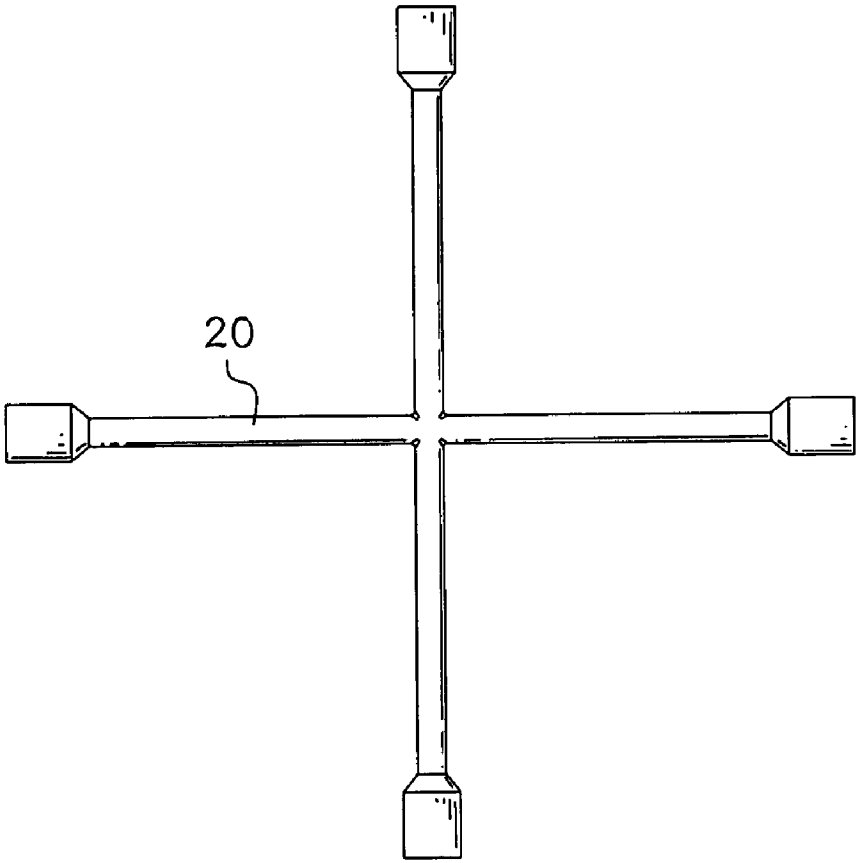
FIG. 8 PRIOR ART
FIG. 8 shows another conventional driving tool.

Referring to FIGS. 4 to 6, another embodiment of driving tool of the present invention comprises a driving head 10A and two passages 12A are defined through the driving head 10A, and two axes of the two passages 12A are perpendicular to each other. The two passages 12A each form two apertures through a wall of the driving head 10A, and each aperture includes a straight inner periphery 120. Two holes 13 are defined through a top and a bottom of the driving head 10 and each have a threaded inner periphery 130.

Two tool bars 40, 40A respectively and movably extend through the two passages 12A and each of the two tool bars 40, 40A includes an elongate rod 42/42A and has a positioning portion 420/420A which is a plane surface and is engaged with the straight inner periphery 120 of the aperture corresponding thereto.

Two positioning members 30A are respectively engaged with two holes 13 defined through the top and the bottom of the driving head 10. Two positioning members 30A each having a shank portion 31A so as to contact the positioning portions 420, 420A of the two tool bars 40, 40A respectively and the tool bars 20 are not rotatable in the passages 12A.

The two respective shank portions 31A each have a threaded outer periphery 32A so as to be threadedly connected to the two respective threaded inner peripheries 130. A display end surface 33A is defined in a distal end of a top surface of each of the positioning members 30A and a display pattern 34A is connected on the display end surface 33. A biasing member 50 is received in the driving head 10A and has two durable pads 51 for being in contact with the two tool bars 40, 40A and biased between the two tool bars 40, 40A to further positioning the two tool bars 40, 40A. The tool bars 40, 40A each include a driving end 41/41A with a recess defined in a first end thereof. A connection end 43 is formed at a second end of the too bar 42 so as to be connected to a socket. The tool bar 42A has another driving end 41A connected to a second end thereof.

The bar 20 and the tool bars 40, 40A are well positioned in the passage 12/12A of the driving head 10 so that the bar 20 and the tool bars 40, 40A are not rotatable during operation. The positioning member 30, 30A provide proper friction so that the bar 20 and the tool bars 40, 40A do not slip even if they are oriented an angle. The length of the arm of force can be adjusted by pulling the bar 20 and the tool bars 40, 40A. The positioning member 30 and the biasing member 50 are easily to make and can be employed depending practical needs. The bar 20 and the tool bars 40, 40A need not extra or complicated machining processes and can be easily to be manufactured.

While we have shown and described the embodiment in accordance with the present invention, it should be clear to those skilled in the art that further embodiments may be made without departing from the scope of the present invention on.

What is claimed is:

1. A driving tool comprising:

a driving head (10) and a passage (12) defined through the driving head (10), a driving protrusion (11) extending from a bottom end of the driving head (10), a top hole (13) defined through a top of the driving head (10), a positioning member (30) received in the driving head (10) and including two arms (31) and a top portion (32) which extends through the top hole (13) of the driving head (10), a display end surface (33) defined in a distal end of the top portion (32) and projecting out from the top hole (13), a display pattern (34) connected on the display end surface (33), and a bar (20) movably extending through the passage (12) and having a positioning portion (21), the two arms (31) received in the passage (12) and in contact with the positioning portion (21) of the bar (20) so that the bar (20) is not rotatable in the passage (12).

2. The driving tool as claimed in claim 1, wherein the positioning portion (21) of the bar (20) is a plane surface (21) and two boss (23) engaged with two recesses (22) defined in two ends of the positioning portion (21) so as to prevent the bar (20) from dropping out from the passage (12).

3. The driving tool as claimed in claim 1 further comprising a connection rod (40) which has a driving end (41) with a recess in a first end thereof so as to receive the driving protrusion (11) on the driving head (10) and a connection end (43) connected to a second end of the connection rod (40), a plane surface (420) defined in an outer surface of the connection rod (40).

4. A driving tool comprising:

a driving head (10A) and two passages (12A) defined through the driving head (10A), two axes of the two passages (12A) being perpendicular to each other, two holes (13) defined through a top and a bottom of the driving head (10);

two positioning members (30A) respectively engaged with the two holes (13) in the top and bottom of the driving head (10);

two tool bars (40, 40A) respectively and movably extending through the two passages (12A), each of the two tool bars (40, 40A) having a positioning portion (420, 420A) which are respectively engaged with the two positioning-member (30A) so that the tool bars (20) are not rotatable in the passages (12A), and a biasing member (50) received in the driving head (10A) and biased between the two tool bars (40, 40A).

5. The driving tool as claimed in claim 4, wherein the two passages (12A) each form two apertures through a wall of the driving head (10A), each aperture includes a straight inner periphery (120) as to match with the two respective positioning portions (420, 420A) of the two tool bars (40, 40A).

6. The driving tool as claimed in claim 4, wherein each of the tool bars (40, 40A) is an elongate rod, one of the two tool bars including two driving ends (41A) connected to two ends thereof and each driving end (41A) having a recess defined therein, the other tool bar (42) having a driving end (41) at a first end thereof and a connection end (43) at a second end thereof.

7. The driving tool as claimed in claim 4, wherein the two holes (13) defined through the top and the bottom of the driving head (10) each have a threaded inner periphery (130), two positioning members (30A) each having a shank portion (31A) so as to contact the positioning portions (420, 420A) of the two tool bars (40, 40A) respectively, the two respective shank portions (31A) having threaded outer periphery (32A) so as to be threadedly connected to the two respective threaded inner peripheries (130), a display end surface (33A) defined in a distal end of a top surface of each of the positioning members (30A) and a display pattern (34A) connected on the display end surface (33).

8. The driving tool as claimed in claim 4, wherein the biasing member (50) has two durable pads (51) for being in contact with the tool bars (40, 40A).

* * * * *